US007172258B2

(12) United States Patent
Bisson et al.

(10) Patent No.: US 7,172,258 B2
(45) Date of Patent: Feb. 6, 2007

(54) PARTITIONING SYSTEM FOR DRAWER AND FASTENING ARRANGEMENT THEREFOR

(75) Inventors: Serge Bisson, Saint-Jean-Port-Joli (CA); Marc Laurendeau, Saint-Jean-Port-Joli (CA)

(73) Assignee: Rousseau Metal Inc., Sain-Jean-Port-Joli (CA)

( * ) Notice: Subject to any disclaimer, the term of this patent is extended or adjusted under 35 U.S.C. 154(b) by 222 days.

(21) Appl. No.: 10/814,348

(22) Filed: Apr. 1, 2004

(65) Prior Publication Data

US 2005/0218763 A1 Oct. 6, 2005

(51) Int. Cl.
*A47B 88/20* (2006.01)

(52) U.S. Cl. ..... 312/348.3; 312/348.1; 220/529; 220/533

(58) Field of Classification Search ..... 312/348.1, 312/348.3, 330.1; 220/529, 532, 533
See application file for complete search history.

(56) References Cited

U.S. PATENT DOCUMENTS

| | | | | |
|---|---|---|---|---|
| 1,523,136 | A | 1/1925 | O'Connor | |
| 1,757,141 | A | 5/1930 | Raster | |
| 1,939,651 | A | 12/1933 | Bales | 220/22 |
| 1,995,335 | A | 3/1935 | Wilke | 312/140 |
| 2,145,106 | A | 1/1939 | Anderson | 220/22 |
| 2,214,042 | A | 9/1940 | Burdick | 220/22 |
| 2,586,925 | A | 2/1952 | Drengberg | 220/22 |
| 2,788,912 | A | 4/1957 | Simonsen | 220/22 |
| 3,227,504 | A * | 1/1966 | Dunham | 312/234.4 |
| 3,433,548 | A * | 3/1969 | Moore | 312/184 |
| 3,954,202 | A | 5/1976 | Petrick | 220/22.1 |
| 4,436,215 | A * | 3/1984 | Kleinert et al. | 220/533 |
| 4,573,731 | A | 3/1986 | Knaack et al. | 296/376 |
| 4,577,773 | A * | 3/1986 | Bitel | 220/533 |
| 4,595,246 | A | 6/1986 | Bross | 312/330 R |
| 5,299,688 | A * | 4/1994 | McKay et al. | 206/425 |
| 5,553,710 | A | 9/1996 | Takama | 206/561 |
| 5,664,856 | A | 9/1997 | Pacetti | 312/348.3 |
| 6,073,794 | A | 6/2000 | Bidot | 220/529 |
| 6,443,544 | B1 * | 9/2002 | Wolf et al. | 312/348.1 |

FOREIGN PATENT DOCUMENTS

| | | |
|---|---|---|
| CH | 644742 | * 8/1984 |
| DE | 3810531 | 10/1989 |
| FR | 2303722 | 11/1976 |
| GB | 2134884 | 8/1984 |

* cited by examiner

*Primary Examiner*—James O. Hansen
*Assistant Examiner*—Philip Gabler
(74) *Attorney, Agent, or Firm*—McDermott Will & Emery LLP

(57) ABSTRACT

A fastening arrangement is for fastening a partitioning wall between two support walls in a drawer. A pair of elongated blades punched the partitioning wall at ends thereof are slideably engageable in retaining channels provided by connecting elements projecting from the support walls. The retaining channels have opposite side locking lips forming guiding slots for passage of a section of the partitioning wall extending between the connecting elements. The blades of the partitioning wall respectively press-fit against inner sides of the channels behind the locking lips when the partitioning wall is in the operative position. Lower support elements projecting from the support walls have guiding slots in which the ends of the partitioning wall are slideably engageable.

18 Claims, 5 Drawing Sheets

PARTITIONING SYSTEM FOR DRAWER AND FASTENING ARRANGEMENT THEREFOR

FIELD OF THE INVENTION

The present invention relates to drawer partitioning, and more particularly to a drawer partitioning system and a fastening arrangement therefor. The partitioning system and the fastening arrangement according to the present invention are particularly useful for modular drawers in a tool cabinet and for other storage equipment having drawers or trays.

BACKGROUND

Modular and other kinds of drawers are often partitioned by a system of partitions and dividers for facilitating the organization of the content to be stored or for other purposes. One popular type of partitioning system consists of vertical slots on the peripheral wall of the drawer which can receive partitions. The partitions are also provided with slots for receiving dividers possibly made of a mere sheet of steel which may have longitudinal folds for strengthening purposes. This type of system is simple and functional but has various drawbacks. Because of the impacts between the content and the back of the drawer caused by the repeated closing of the drawer, the back can bend backwards and the partitions can then disengage. If the compartments on one side of a partition are loaded while the compartments on the other side of the partition are not, the loads may cause the dividers and the partition to bend and disengage. The dividers are sometimes made of a steel sheet engaging in the slots of the separators. As a result, they may vibrate in the slots of the separators during operation of the drawer and produce an undesirable noise. Furthermore, the dividers move from time to time upwardly in the slots and small articles may get stuck under the divider and even cross it from one compartment to another.

Examples of prior art partitioning systems are given in U.S. Pat. No. 1,523,136 (O'Connor), U.S. Pat. No. 1,757,141 (Raster), U.S. Pat. No. 1,939,651 (Bales), U.S. Pat. No. 1,995,335 (Wilke), U.S. Pat. No. 2,145,106 (Anderson), U.S. Pat. No. 2,214,042 (Burdick), U.S. Pat. No. 2,586,925 (Drengberg), U.S. Pat. No. 2,788,912 (Simonsen), U.S. Pat. No. 3,954,202 (Petrick), U.S. Pat. No. 4,573,731 (Knaack et al.), U.S. Pat. No. 4,595,246 (Bross), U.S. Pat. No. 5,553,710 (Takama), U.S. Pat. No. 5,664,856 (Pacetti), U.S. Pat. No. 10 6,073,794 (Bidot), CH patent No. 644,742, DE patent No. 3810531, UK patent No. 2,134,884, and FR patent No. 2,303,722. In general, the partitioning systems are relatively complex, occupy important space in the drawer, require special drawer structural arrangements, are difficult to use, or have elements which may undesirably disengage in certain circumstances.

SUMMARY

An object of the invention is to provide a drawer partitioning system and a fastening arrangement therefor which are simple, economical and exempt from undesired disengagements of the partitions.

Another object of the invention is to provide such a drawer partitioning system and a fastening arrangement therefore which have stronger and more fitting interconnections.

Another object of the invention is to provide such a drawer partitioning system and a fastening arrangement therefore which facilitates insertion of the partitions.

Another object of the invention is to provide such a drawer partitioning system and fastening arrangement therefore, which have partitions whose length may be more precise compared to conventional systems.

According to the present invention, there is provided a fastening arrangement for fastening a partitioning wall between two support walls in a drawer, comprising:

a pair of elongated blades punched in the partitioning wall and projecting sideways from the partitioning wall adjacent ends thereof at a predetermined height of the partitioning wall; and opposite connecting elements respectively projecting from the support walls at heights matching with the height of the blades of the partitioning wall when the partitioning wall is in operative position between the support walls, the connecting elements having retaining channels in which the ends of the partitioning wall are uprightly slideably engageable, the retaining channels having opposite side locking lips forming guiding slots for passage of a section of the partitioning wall extending between the connecting elements, the blades of the partitioning wall respectively press-fitting against inner sides of the channels behind the locking lips when the partitioning wall is in the operative position.

According to the present invention, there is also provided a partitioning system for a drawer with at least two opposite support walls, comprising:

a partitioning wall having a pair of elongated blades punched in the partitioning wall and projecting sideways from the partitioning wall adjacent ends thereof at a predetermined height of the partitioning wall; and connecting elements respectively projecting from the support walls at heights matching with the height of the blades of the partitioning wall when the partitioning wall is in operative position between the support walls, the connecting elements having retaining channels in which the ends of the partitioning wall are uprightly slideably engageable, the retaining channels having opposite side locking lips forming guiding slots for passage of a section of the partitioning wall extending between the connecting elements, the blades of the partitioning wall respectively press-fitting against inner sides of the channels behind the locking lips when the partitioning wall is in the operative position.

Opposite support elements may respectively project from the support walls at another height with respect to the connecting elements, the support elements respectively having guiding slots in which the ends of the partitioning wall are slideably engageable, the guiding slots of the support elements being aligned with the guiding slots of the retaining channels of the connecting elements.

BRIEF DESCRIPTION OF THE DRAWINGS

A detailed description of a preferred embodiment will be given herein below with reference to the following drawings, in which like numbers refer to like elements.

DETAILED DESCRIPTION OF A PREFERRED EMBODIMENT

Figure 1:
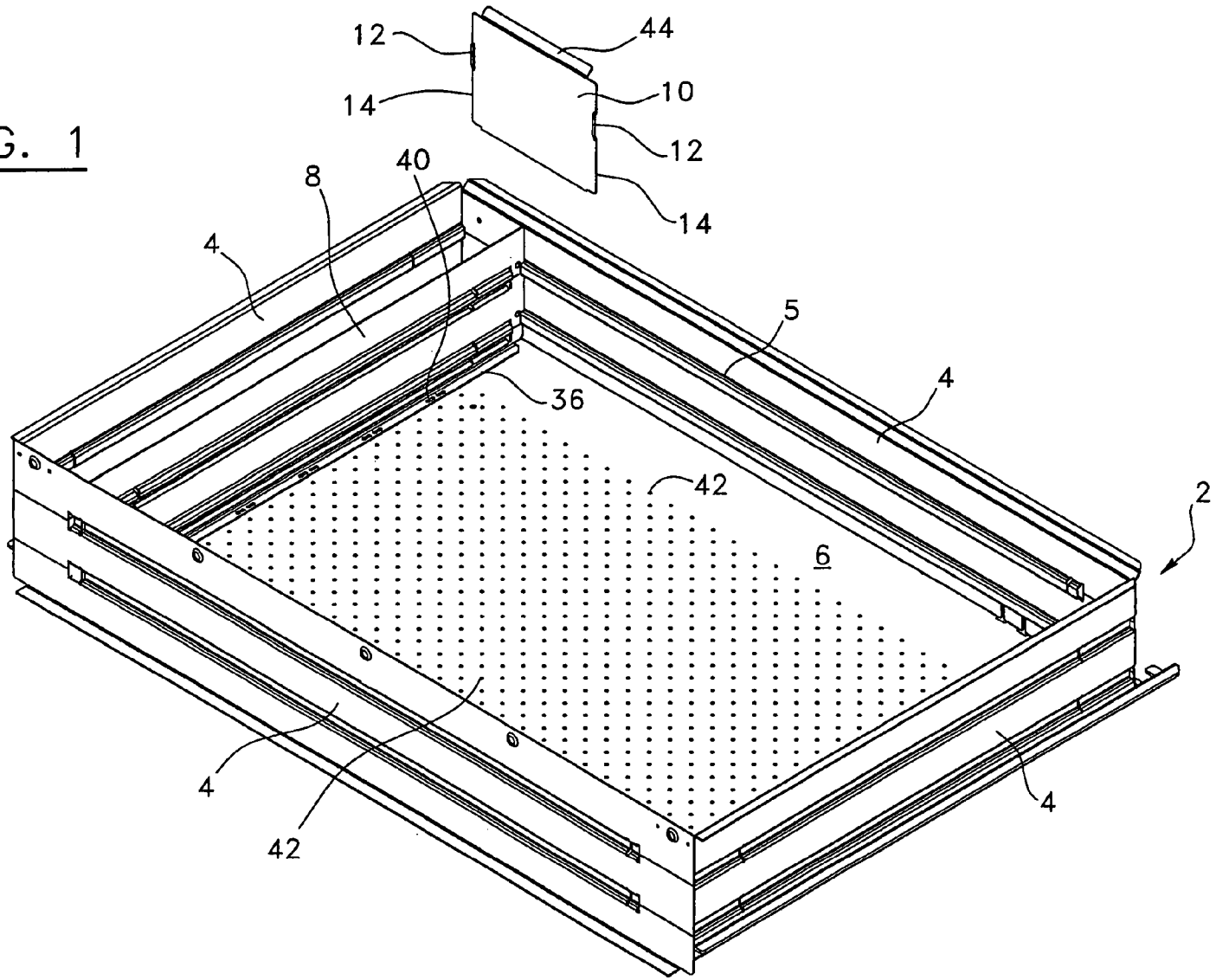
FIG. 1 is a perspective view of a partitioning system and fastening arrangement according to the present invention.

Referring to FIG. 1, there is shown a drawer 2 having peripheral and bottom walls 4, 6. The drawer 2 is provided with a partitioning wall 8 having ends inserted in slots in bulging members 5 extending along the side peripheral walls 4, which act as support walls for the partitioning wall 8. Another partitioning wall 10 attachable to the partitioning wall 8 is provided. The partitioning wall 8 then also acts as a support wall for the partitioning wall 10. Normally, the partitioning wall 10 will be mounted between two support walls, for example the partitioning wall 8 and a similar partitioning wall (not shown) extending between the side peripheral walls 4, or the partitioning wall 8 and one of the front and rear peripheral walls 4.

Figure 2:
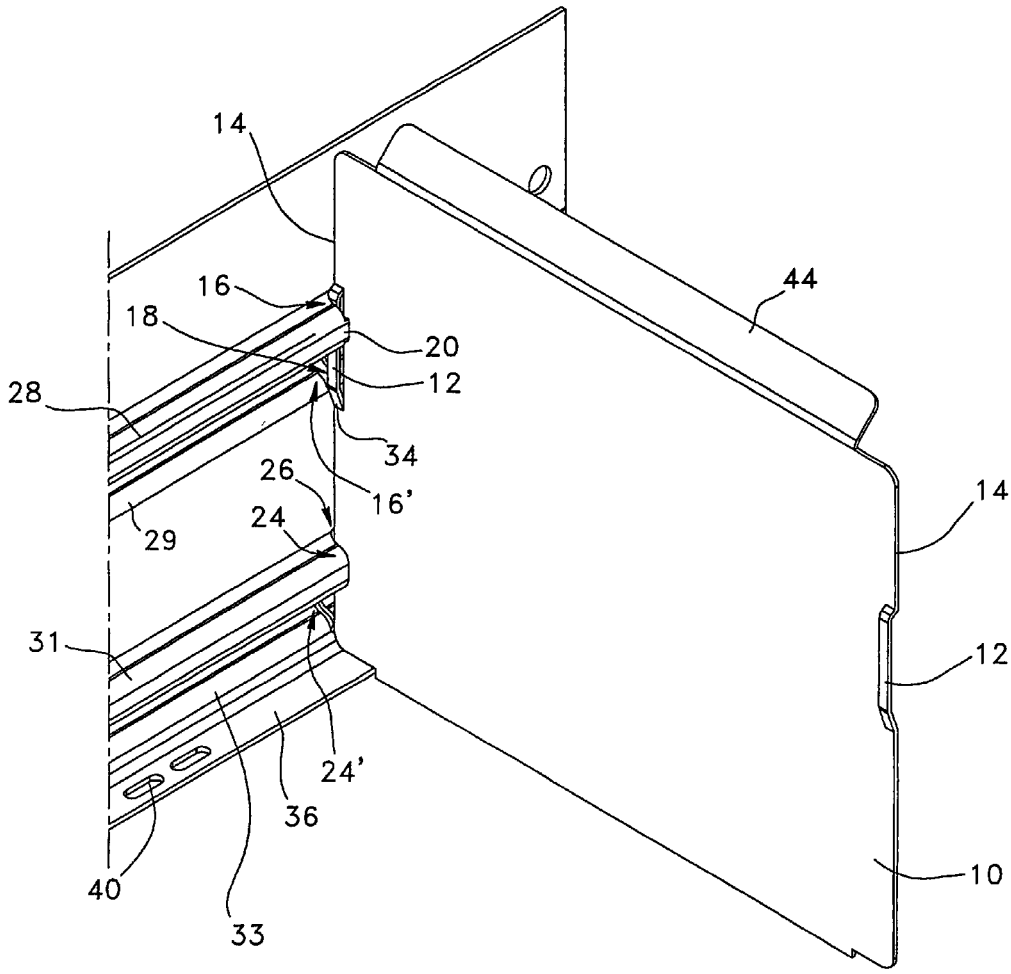
FIG. 2 is a perspective partial view of a partitioning wall in operative position with a support wall according to the present invention.

Referring to FIG. 2, according to the disclosed fastening arrangement, a pair of elongated blades 12 punched in the partitioning wall 10 project sideways from adjacent ends 14 of it at a predetermined height. The blades 12 may extend directly at the ends 14, as in the illustrated case. But they may also extend not exactly at the ends 14, e.g. at a given distance from the ends 14.

Figure 3:
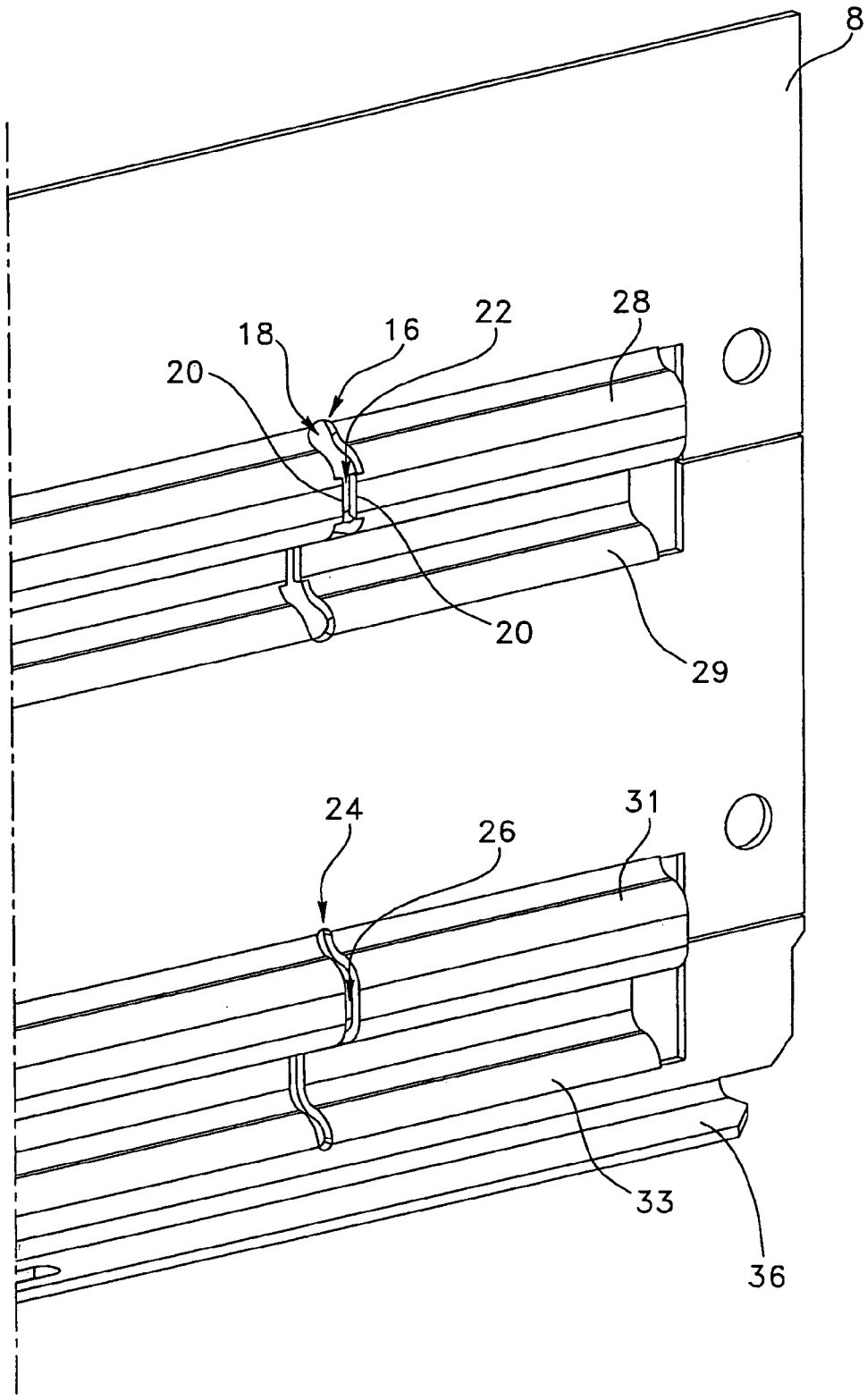
FIG. 3 is a perspective partial view of a support wall according to the present invention.

Referring to FIG. 3, also according to the disclosed fastening arrangement, the support walls, as the partitioning wall 8 in the illustrated case, have opposite connecting elements 16. These connecting elements 16 respectively project at heights matching with the height of the blades 12 of the partitioning wall 10 when it is in operative position, i.e. fastened to two of the support walls. The connecting elements 16 have retaining channels 18 in which the ends 14 of the partitioning wall 10 (shown in FIG. 2) are uprightly slideably engageable. The retaining channels 18 have opposite side locking lips 20 forming guiding slots 22 for passage of a section of the partitioning wall 10 extending between the connecting elements 16. The blades 12 of the partitioning wall 10 are adapted to respectively press-fit against inner sides of the channels 18 behind the locking lips 20 when the partitioning wall 10 is in the operative position. The lateral projection of the blades 12 with respect to the general plane of the partitioning wall 10 and the width of the channels 18 should thus be adjusted for this purpose when manufacturing the pieces. Preferably, the retaining channels 18 are wide enough and symmetric to slideably receive any end 14 of the partitioning wall 10, thus allowing use of the partitioning wall 10 in turned back position as well.

The support walls (as the partitioning wall 8 in the illustrated case) also have opposite support elements 24 respectively projecting at another height with respect to the connecting elements 16. In the illustrated case, the support elements 24 are located below the connecting elements 16, closer to the bottom wall 6 of the drawer 2. The support elements 24 respectively have guiding slots 26 in which the ends 14 of the partitioning wall 10 are slideably engageable. The guiding slots 26 of the support elements 24 should be aligned with the guiding slots 22 of the retaining channels 18 of the connecting elements 16. The support elements 24 could instead be located above the connecting elements 16 if necessary, but this would require additional manipulation of the dividing wall 10 when mounting it due to the presence of the blades 12. The connecting and support elements 16, 24 should preferably be spaced from each other so as to provide firm support to the partitioning wall 10.

It should be noted that the presence of the support elements 24 is mainly intended to increase the stability of the partitioning wall 10, and they may be omitted if desired. In drawers having reduced height, it may be difficult, undesirable or even impossible to provide support elements 24 and they will not be required. Thus, the drawers may be provided with only connecting elements 16 if desired.

Figure 4:
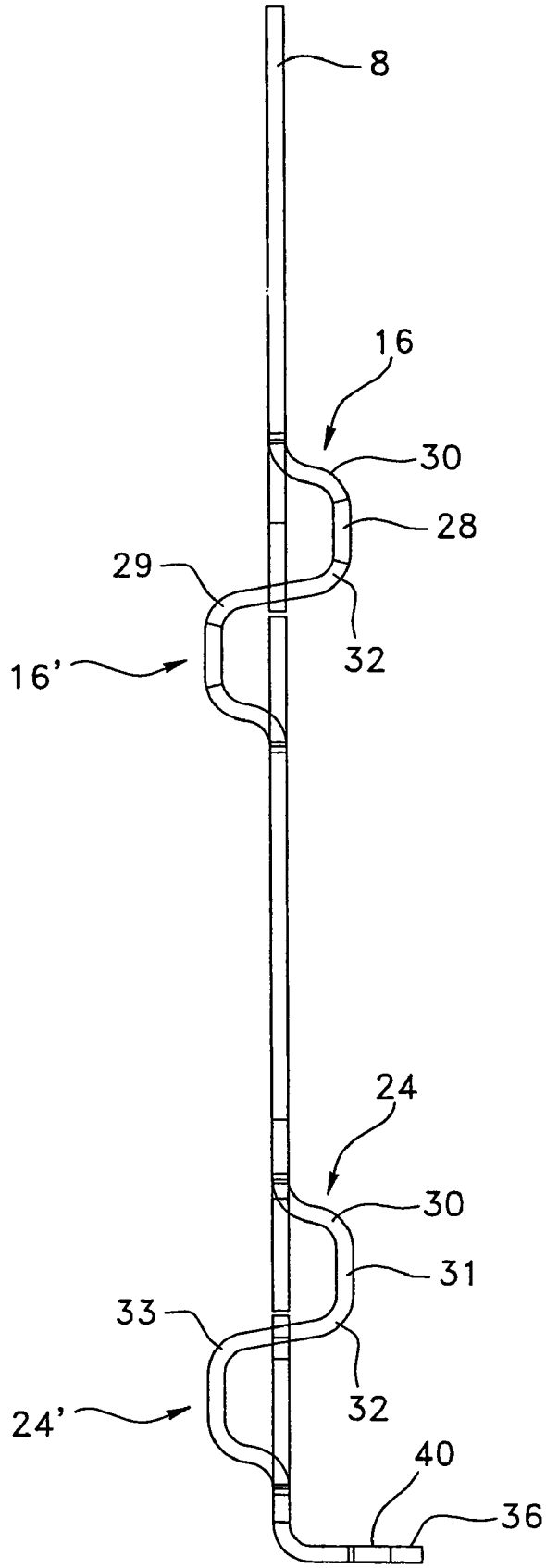
FIG. 4 is a side view of a support wall according to the present invention.

Referring to FIG. 4, the connecting and support elements 16, 24 may conveniently be provided in the form of longitudinal extrusions 28, 31 made in the support walls (e.g. the partitioning wall 8) by means of a punching or other appropriate process. The extrusions 28, 31 project on a side of the support walls and may have rounded upper and lower surfaces 30, 32 joining the support walls. The retaining channels 18 of the connecting elements 16 and the guiding slots 26 of the support elements 24 are then made in the extrusions 28, 31, so as to extend crosswise to the extrusions 28, 31.

The support walls may conveniently have additional connecting elements 16' projecting at a height matching with the height of the blades 12 of the partitioning wall 10 when the partitioning wall 10 is in the operative position between the support walls, and an additional support element 24' projecting from the support walls at another height with respect to the additional connecting element 16'. The additional connecting and support elements 16', 24' are respectively like the connecting and support elements 16, 24 already made in the support walls, but they project on a side of the support walls opposite to a side on which the connecting and support elements 16, 24 already made in the support walls project. The connecting elements 16, 16' of the support walls may extend successively one above the other, while the support elements 24, 24' of the support walls may extend successively one above the other.

The connecting and support elements 16', 24' may be provided in the form of longitudinal extrusions 29, 33 made in the support walls. The extrusions 29, 33 may be complementary to the extrusions 28, 31 but on the other side of the partitioning wall 8.

The connecting and support elements 16 (16'), 24 (24') may be made otherwise, for example by welding them on the support walls. They may be combined into a single piece affixable to the corresponding support wall. They may be formed of a number of separate connecting or support elements arranged next to one another to provide respectively the channels 18 and the slots 26.

Figure 5:
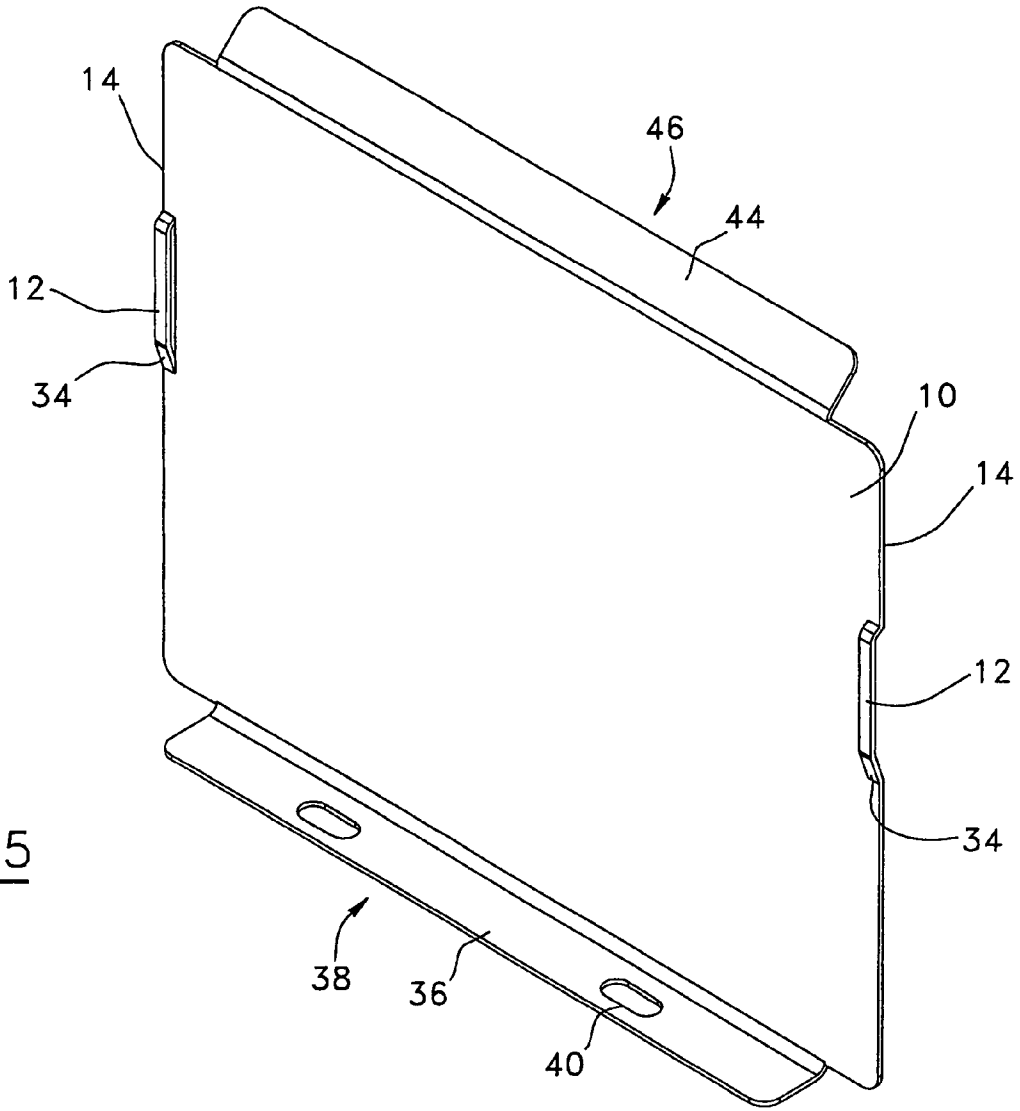
FIG. 5 is a perspective view of a partitioning wall according to the present invention.

Referring now to FIGS. 2 and 5, the blades 12 of the partitioning wall 10 may be provided with lower ramp-like surfaces 34 facilitating insertion of the blades 12 in the retaining channels 18.

The blades 12 may project perpendicularly to the partitioning wall 10 or at another angle so that the partitioning wall 10 may be mounted also at an angle between the support walls provided that its length is adapted for this purpose, e.g. shorter or longer than for straight mounting between support walls. Likewise, the retaining channels 18 may be adapted to be compatible with such a configuration for example by having smaller locking lips 20. The ends 14 of the partitioning wall 10 may also be folded with respect to the major body of the partitioning wall 10 for mounting it at an angle without requiring changes to the channels 16 and slots 26 and blades 12.

As best shown in FIG. 1, the partitioning wall 8 may be provided with a seating flange 36 projecting from its bottom end and extending laterally from the partitioning wall 8. The seating flange 36 may have screw fitting holes 40 for fastening the partitioning wall 8 to the bottom wall 6 of the drawer 2 using e.g. tapping screws (not shown) engageable in holes 42 in the bottom wall 6. Such a fastening of the flange 36 to the bottom wall 6 of the drawer 2 may strengthen the drawer 2 and prevent the bottom wall 6 from bending under the weight of articles stored in the drawer 2, thereby providing the drawer 2 with a longer lifetime.

As best shown in FIG. 5, the partitioning wall 10 may also be provided with a seating flange 36 and therefore may be fastened to the bottom wall 6 of the drawer 2. Such a fastening of the partitioning wall 10 to the bottom wall 6 of the drawer 2 may be achieved for the purpose of preventing articles from passing under the partitioning wall 10 and to further strengthen the bottom of the drawer 2 and the global structure of the partitioning system.

The press-fitting assembly between the partitioning wall 10 and the support walls, combined to the retaining action of the lips 20, prevents undesired disengagement of the partitioning wall 10 and provides steady fastening of the partitioning wall 10 between the support walls. Consequently, no noise is produced by the possible vibrations of the drawer 2 when it is opened or closed. Since the partitioning wall 10 is firmly hold in place, it is not prone to move up and it is thus unnecessary to screw it to the bottom of the drawer 2 to prevent articles to pass or get stuck under it. The flange 36 of the partitioning wall 10 may be screwed to the bottom 6 of the drawer 2 when used in more harsh conditions wherein the pieces might be highly solicited, thereby increasing the structural strength of the whole partitioning systems. The disclosed partitioning arrangement is economical to produce and the precision of the length of the partitioning walls is better than with conventional end folds. Due to the geometry of the blades 12, the insertion of the partitioning wall 10 is easier as the ramp-like section 34 guides it and produces a progressive press-fitting in the channel 18.

The partitioning wall 10 (and the support walls) may be provided with a label holding flange 44 if desired. The label holding flange 44 is preferably slantingly projecting, for example at 45°, from a top end 46 of the partitioning wall 10. The flange 44 may be used to hold on identification label (not shown) for the articles stored in the drawer 2. The label holding flange 44 should preferably project above the upper edge of the partitioning wall 10 to remain visible even when the compartment is full.

It is worth noting that in the embodiment described above, as well as other embodiments, the partitioning wall 10 may also have connecting and support elements 16, 16', 24, 24' like those of the support walls 8, therefore forming a support wall 8 for another partitioning wall 10. Alternatively, a partitioning wall like the partitioning wall 8 may be used instead of the partitioning wall 10 if desired, thereby leaving the geometry of the partitioning wall 10 to its simplest expression.

While an embodiment of this invention has been illustrated in the accompanying drawings and described above, it will be evident to those skilled in the art that changes and modifications may be made therein without departing from the essence of this invention. It should be noted that the disclosed fastening arrangement may be applied also between the partitioning wall 8 and the peripheral walls 4 of the drawer 2, and between additional partitioning walls (not shown) and the partitioning wall 10 (then acting as a support wall) in which case the partitioning wall 10 would then be provided with connecting elements like those on the partitioning wall 8 while the additional partitioning walls would be provided with blades like those on the partitioning wall 10.

The invention claimed is:

1. A fastening arrangement for fastening a partitioning wall between two support walls in a drawer, comprising:

a pair of elongated blades, each blade being punched out from the plane of a face of the partitioning wall along a vertical separation at a corresponding adjacent end of said face of the partitioning wall, each blade being contiguous with the partitioning wall along a horizontal connection, and each blade comprising at a predetermined height a face parallel to said face of the partitioning wall and further comprising a lower ramp surface defined between said horizontal connection and said predetermined height; and opposite connecting elements respectively projecting from the support walls at heights matching with the height of the blades of the partitioning wall when the partitioning wall is in operative position between the support walls, the connecting elements having retaining channels in which the ends of the partitioning wall are uprightly slideably engageable, the retaining channels having opposite side locking lips forming guiding slots for passage of a section of the partitioning wall extending between the connecting elements, the ramp surfaces of the blades of the partitioning wall being shaped and sized for facilitating insertion of the blades in the retaining channels and for respectively and progressively press-fitting against inner sides of said channels behind the locking lips when the partitioning wall is in the operative position.

2. The fastening arrangement according to claim 1, further comprising: opposite support elements respectively projecting from the support walls at another height with respect to the connecting elements, the support elements respectively having guiding slots in which the ends of the partitioning wall are slideably engageable, the guiding slots of the support elements being aligned with the guiding slots of the retaining channels of the connecting elements.

3. The fastening arrangement according to claim 2, wherein the connecting and support elements comprise longitudinal extrusions made in the support walls and projecting on a side thereof, the retaining channels and the guiding slots being made in and extending crosswise to the extrusions of respective ones of the connecting and support elements.

4. The fastening arrangement according to claim 3, wherein the extrusions have substantially rounded upper and lower surfaces joining the support walls.

5. The fastening arrangement according to claim 2, wherein the support elements extend below the connecting elements.

6. The fastening arrangement according to claim 2, comprising an additional connecting element projecting from at least one of the support walls at a height matching with the height of the blades of the partitioning wall when the partitioning wall is in the operative position between the support walls, and an additional support element projecting from said at least one of the support walls at another height with respect to the additional connecting element, the additional connecting and support elements being respectively like the connecting and support elements already made in said at least one of the support walls but projecting on a side of said at least one of the support walls opposite to a side on which the connecting and support elements already made in said at least one of the support walls project.

7. The fastening arrangement according to claim 6, wherein the connecting elements of said at least one of the support walls extend successively one above the other, and the support elements of said at least one of the support walls extend successively one above the other.

8. The fastening arrangement according to claim 7, wherein the connecting and support elements comprise longitudinal extrusions made in the support walls and projecting on respective sides thereof, the retaining channels being made in and extending crosswise to the extrusions of the connecting elements, the guiding slots of the support elements being made in and extending crosswise to the extrusions of the support elements.

9. The fastening arrangement according to claim 1, wherein the blades extend directly at the ends of the partitioning wall.

10. The fastening arrangement according to claim 1, comprising a seating flange projecting from a bottom end of the partitioning wall and extending laterally with respect thereto.

11. The fastening arrangement according to claim 1, comprising an additional connecting element projecting from at least one of the support walls at a height matching with the height of the blades of the partitioning wall when the partitioning wall is in the operative position between the support walls, the additional connecting element being like the connecting element already made in said at least one of the support walls but projecting on a side of said at least one of the support walls opposite to a side on which the connecting element already made in said at least one of the support walls projects.

12. A partitioning system for a drawer with at least a first and a second opposite support wall, comprising:

at least a first partitioning wall having a pair of elongated blades, each blade being punched out from the plane of a face of the partitioning wall, along a vertical separation at a corresponding adjacent end of said face of the partitioning wall, each blade being contiguous with the partitioning wall along a horizontal connection, each blade comprising at a predetermined height a face parallel to said face of the partitioning wall and further comprising a lower ramp surface defined between said horizontal connection and said predetermined height; and connecting elements respectively projecting from the support walls at heights matching with the height of the blades of the partitioning wall when the partitioning wall is in operative position between the support walls, the connecting elements having retaining channels in which the ends of the partitioning wall are uprightly slideably engageable, the retaining channels having opposite side locking lips forming guiding slots for passage of a section of the partitioning wall extending between the connecting elements, the ramp surfaces of the blades of the partitioning wall being shaped and sized for facilitating insertion of the blades in the retaining channels and for respectively and progressively press-fitting against inner sides of said channels behind the locking lips when the partitioning wall is in the operative position.

13. The partitioning system according to claim 12, comprising: opposite support elements respectively projecting from the support walls at another height with respect to the connecting elements, the support elements respectively having guiding slots in which the ends of the partitioning wall are slideably engageable, the guiding slots of the support elements being aligned with the guiding slots of the retaining channels of the connecting elements.

14. The partitioning system according to claim 13, wherein the connecting and support elements comprise longitudinal extrusions made in the support walls and projecting on an inner side thereof, the retaining channels and the guiding slots being made in and extending crosswise to the extrusions of respective ones of the connecting and support elements.

15. The partitioning system according to claim 13, wherein the support elements extend below the connecting elements.

16. The partitioning system according to claim 12, wherein the blades extend directly at the ends of the partitioning wall.

17. The partitioning system according to claim 12, comprising a seating flange laterally projecting from a bottom end of the partitioning wall.

18. The partitioning system according to claim 12, wherein the partitioning wall has a label holding flange slantingly projecting from a top end of the partitioning wall.

* * * * *